US005992010A

United States Patent [19]

Zamanzadeh

[11] Patent Number: 5,992,010

[45] Date of Patent: Nov. 30, 1999

[54] COAXIAL CABLE CONNECTOR TOOL

[76] Inventor: Manouchehr Zamanzadeh, 20 Millwood Ave., Mill Valley, Calif. 94941

[21] Appl. No.: 08/963,032

[22] Filed: Nov. 3, 1997

[51] Int. Cl.[6] ..... H01R 43/22

[52] U.S. Cl. ..... 29/747; 29/748; 29/828

[58] Field of Search ..... 29/747, 748, 752, 29/762, 828

[56] References Cited

U.S. PATENT DOCUMENTS

| | | | |
|---|---|---|---|
| 3,205,567 | 9/1965 | Irvine et al. | 29/747 |
| 3,345,692 | 10/1967 | Cobaugh et al. | 29/747 |
| 3,553,835 | 1/1971 | Demler, Sr. et al. | 29/828 X |
| 3,824,686 | 7/1974 | Forney, Jr. | 29/828 |
| 4,059,330 | 11/1977 | Shirey | 29/828 X |
| 5,511,305 | 4/1996 | Garner | 29/828 |
| 5,577,310 | 11/1996 | Cheene-Astorino et al. | 29/828 X |
| 5,845,393 | 12/1998 | DePaiva | 29/828 X |

*Primary Examiner*—Lee Young
*Assistant Examiner*—Rick Kiltae Chang
*Attorney, Agent, or Firm*—Jack Lo

[57] ABSTRACT

A coaxial cable connector tool includes a hollow elongated housing comprised of two halves hinged together. The halves are closed around a female coaxial cable connector. When the halves are closed, a hexagonal hole is formed at one end, and another hole is formed at the opposite end. The hexagonal sleeve on the connector is snugly positioned in the hexagonal hole, and the cable is positioned through the opposite hole. The sleeve is rotated by turning the housing by hand. The housing is substantially wider than the sleeve on the connector, and includes a hexagonal outer surface, so that it may be easily gripped and turned by hand. In a second embodiment, the housing is provided as a built-in component on new connectors.

7 Claims, 1 Drawing Sheet

COAXIAL CABLE CONNECTOR TOOL

CROSS REFERENCE TO RELATED APPLICATIONS

Not applicable.

BACKGROUND OF THE INVENTION

1. Field of the Invention

This invention relates generally to tools, such as wrenches, for turning coaxial cable connectors.

2. Prior Art

A typical coaxial cable includes a female connector at one end for connecting to a male connector on a piece of equipment, such as a television, computer network card, etc. The female connector includes a coaxial, freely rotating, internally threaded sleeve for screwing onto the threaded male connector. The sleeve includes a hexagonal exterior surface for being turned by conventional wrenches. However, having to find a wrench is inconvenient, and some households do not own wrenches. Most users connecting a television tend to turn the connectors by hand, but that is difficult and somewhat painful due to the tightness of the fit.

OBJECTS OF THE INVENTION

Accordingly, objects of the present coaxial cable connector tool are:

- to help attach a female coaxial cable connector to a male connector;
- to enable the connector to be easily turned by hand;
- to be easily attachable to existing cables; and
- to be alternatively provided as a built-in tool on new cables.

Further objects of the present invention will become apparent from a consideration of the drawings and ensuing description.

BRIEF SUMMARY OF THE INVENTION

A coaxial cable connector tool includes a hollow elongated housing comprised of two halves hinged together. The halves are closed around a female coaxial cable connector. When the halves are closed, a hexagonal hole is formed at one end, and another hole is formed at the opposite end. The hexagonal sleeve on the connector is snugly positioned in the hexagonal hole, and the cable is positioned through the opposite hole. The sleeve is rotated by turning the housing by hand. The housing is substantially wider than the sleeve on the connector, and includes a hexagonal outer surface, so that it may be easily gripped and turned by hand. In a second embodiment, the housing is provided as a built-in component on new connectors.

Figure 1:
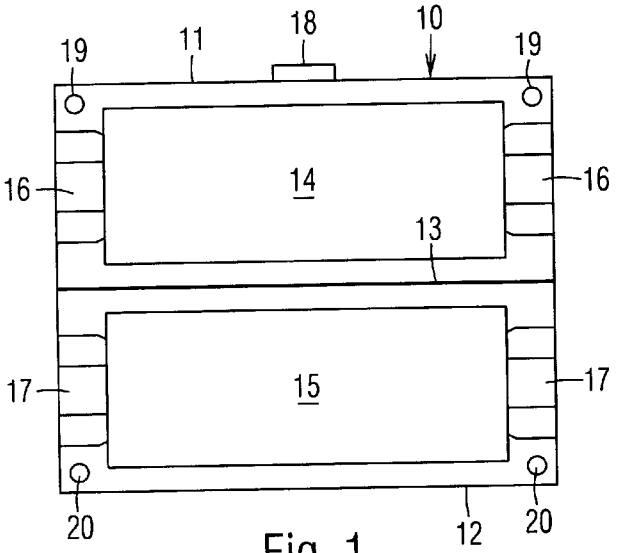
FIG. 1 is a side view of a first embodiment of a coaxial cable connector tool in an opened condition.

| DRAWING REFERENCE NUMERALS | |
|---|---|
| 10. Housing | 11. Half |
| 12. Half | 13. Hinge |
| 14. Hollow Depression | 15. Hollow Depression |
| 16. Semi-Hexagonal Notch | 17. Semi-Hexagonal Notch |
| 18. Latch | 19. Pins |
| 20. Holes | 21. Coaxial Cable Connector |
| 22. Hexagonal Hole | 23. Hexagonal Sleeve |
| 24. Chamber | 25. Hexagonal Outer Surface |
| 26. Housing | 27. Coaxial Cable Connector |

DETAILED DESCRIPTION OF THE INVENTION

FIGS. 1–2

Figure 2:
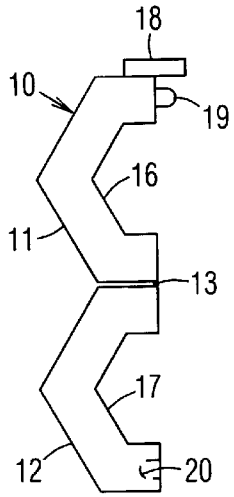
FIG. 2 is an end view of the tool in an opened condition.

As shown in FIGS. 1–2, a first embodiment of the coaxial cable connector includes an elongated housing 10 comprised of two halves 11 and 12 hinged together along a living hinge 13. The halves include hollow central depressions 14 and 15, and semi-hexagonal notches 16 and 17 at opposite ends. A latch 18 is provided on half 11 for locking housing 10 in a closed position. Pins 19 projecting from half 11 frictionally mate with holes 20 on half 12 to further ensure that halves 11 and 12 are aligned and locked when closed.

FIGS. 3–4

Figure 3:
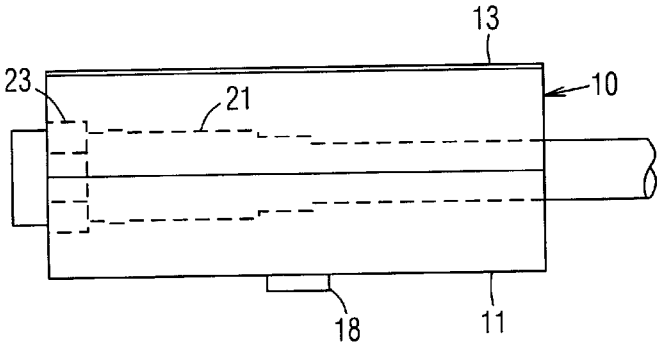
FIG. 3 is a side view of the tool closed around a coaxial cable connector.
Figure 4:
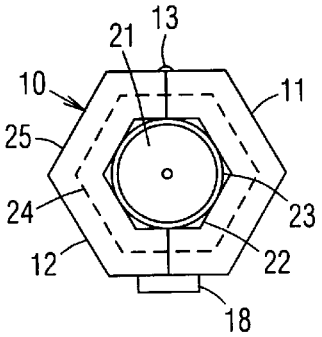
FIG. 4 is an end view of the tool closed around the coaxial cable connector.

The tool is easily attached to an existing coaxial cable connector 21 by closing halves 11 and 12 thereon, as shown in FIGS. 3 and 4. Semi-hexagonal notches 16 and 17 (FIG. 2) cooperate to form hexagonal holes 22 (one shown), one of which is positioned around a rotatable hexagonal sleeve 23 of connector 21. The round distal end of sleeve 23 projects from housing 10. Having hexagonal holes 22 at both ends enables housing 10 to be oriented in either direction when closed around connector 21. The hollow depressions 14 and 15 (FIG. 1) cooperate to form an enlarged chamber 24 which is large enough to accommodate larger connectors (not shown).

Turning housing 10 thus rotates sleeve 23 for attaching connector 21 onto a male coaxial connector (not shown). Housing 10 is substantially wider than connector 21, so that it is much easier to grip securely, and can be easily turned by hand. Further, housing 10 includes a hexagonal outer surface 25 for providing a non-slip grip.

FIG. 5

Figure 5:
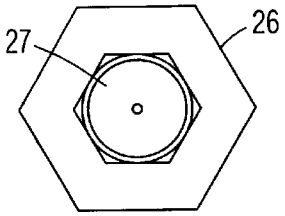
FIG. 5 is an end view of a second embodiment of the tool.

A second embodiment of the connector tool is shown in FIG. 5. It includes a hexagonal tubular housing 26 similar to housing 10 (FIG. 4), except it is not separable into two halves, and is provided as a built-in, non-removable part of a new cable connector 27.

Summary and Scope

Accordingly, a coaxial cable connector tool is provided herein. It is used to attach a female coaxial cable connector to a male connector. It is easily turned by hand. It can be easily attached to existing connectors, or it can be provided as a built-in tool on new connectors.

Although the above description is specific, it should not be considered as a limitation on the scope of the invention, but only as an example of the preferred embodiment. Many substitutes and variations are possible within the teachings of the invention. For example, chamber 24 may be eliminated, so that housing 10 fits closely around connector 21. Only one hole 22 may be hexagonal, and the other hole may be of any other shape. Pins 19 and holes 20 may be eliminated. The exterior of housing 10 may be round instead of hexagonal, and knurls may be provided for improving grip. Any type of latching device may be used for locking housing 10 closed. Therefore, the scope of the invention should be determined by the appended claims and their legal equivalents, not by the examples given.

I claim:

1. A coaxial cable connector tool, comprising:

a tubular housing having a first hole at one end, and a second hole at another end, said housing for positioning around a first coaxial cable connector with a coaxial cable extending therefrom, said first hole having an internal contour for closely engaging a similarly shaped external contour of a rotatable sleeve of said first coaxial cable connector, said housing is rotatable by hand for rotating said sleeve and attaching said first coaxial cable connector to a second coaxial cable connector;

wherein said housing includes a hexagonal outer surface for providing a secure grip.

2. A coaxial cable connector tool, comprising:

a tubular housing having a first hole at one end, and a second hole at another end, said housing for positioning around a first coaxial cable connector with a coaxial cable extending therefrom, said first hole having an internal contour for closely engaging a similarly shaped external contour of a rotatable sleeve of said first coaxial cable connector, said housing is rotatable by hand for rotating said sleeve and attaching said first coaxial cable connector to a second coaxial cable connector;

wherein said first hole comprises a hexagonal hole.

3. A coaxial cable connector tool, comprising:

a tubular housing comprising two halves connected by a longitudinal hinge; and a pair of semi-hexagonal notches arranged at adjacent ends of said halves, said notches meeting to form first and second hexagonal holes at opposites ends of said housing when said halves are closed, said halves for closing around a first coaxial cable connector with a coaxial cable extending therefrom, any one of said first and second hexagonal holes for closely engaging a rotatable hexagonal sleeve of said first coaxial cable connector, said housing is rotatable by hand for rotating said hexagonal sleeve and attaching said first coaxial cable connector to a second coaxial cable connector.

4. The coaxial cable connector tool of claim 3, wherein said housing includes a hexagonal outer surface for providing a secure grip.

5. The coaxial cable connector tool of claim 3, wherein said housing includes an enlarged internal chamber wider than said first hole, said chamber is large enough for accommodating an enlarged coaxial cable connector.

6. The coaxial cable connector tool of claim 3, further including a latch fixedly attached to a first one of said halves, said latch latching onto a second one of said halves and locking said halves in a closed position.

7. The coaxial cable connector tool of claim 3, further including a pair of pins extending from a first one of said halves, and a corresponding pair of holes on a second one of said halves, said pins mating with said holes when said halves are closed so as to align and secure said halves in a closed position.

* * * * *